US011843225B2

(12) United States Patent
Heymann et al.

(10) Patent No.: US 11,843,225 B2
(45) Date of Patent: Dec. 12, 2023

(54) METHODS AND APPARATUS FOR ADAPTIVE CHARGE NEUTRALIZATION

(71) Applicant: Illinois Tool Works Inc., Glenview, IL (US)

(72) Inventors: Steven Bernard Heymann, Los Gatos, CA (US); Edward Anthony Oldynski, Martinez, CA (US); Joseph Cassio, Oakland, CA (US); Juan Guerrero, Berkeley, CA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 17/831,036

(22) Filed: Jun. 2, 2022

(65) Prior Publication Data

US 2022/0407294 A1 Dec. 22, 2022

Related U.S. Application Data

(60) Provisional application No. 63/197,213, filed on Jun. 4, 2021.

(51) Int. Cl.

| | |
|---|---|
| ***H01T 23/00*** | (2006.01) |
| ***H01T 19/00*** | (2006.01) |
| ***H05F 3/06*** | (2006.01) |

(52) U.S. Cl.

CPC ..... *H01T 23/00* (2013.01); *H01T 19/00* (2013.01); *H05F 3/06* (2013.01)

(58) Field of Classification Search

CPC ..... H01T 19/00; H01T 23/00; H05F 3/06

(Continued)

(56) References Cited

U.S. PATENT DOCUMENTS 4,232,355 A * 11/1980 Finger ..... H01T 23/00 96/82

8,416,552 B2 4/2013 Gefter et al.

(Continued)

FOREIGN PATENT DOCUMENTS

| | | |
|---|---|---|
| EP | 0044360 | 1/1982 |
| EP | 3545592 | 10/2019 |

OTHER PUBLICATIONS

SimcoION™ Multichannel Voltage Detection NOVX Model 3352/3362 With Minipulse Option.

(Continued)

*Primary Examiner* — Kevin J Comber

(74) *Attorney, Agent, or Firm* — McAndrews, Held & Malloy, Ltd.

(57) ABSTRACT

An example apparatus for charge neutralization includes: a first emitter nozzle; a power supply configured to supply a high frequency alternating current (AC) signal to the first emitter nozzle; control circuitry configured to: provide a polarity signal to the power supply to generate a DC offset signal, wherein a combination of the high frequency AC signal and the DC offset signal causes the power supply to output a positive ion generation pulse or a negative ion generation pulse; control the polarity signal to cause the power supply to provide a period of positive ion generation and a period of negative ion generation; determine a balance voltage at an output of the first emitter nozzle; and control the polarity signal to adjust a relative durations of the period of positive ion generation and the period of negative ion generation based on the balance voltage.

13 Claims, 8 Drawing Sheets

(58) Field of Classification Search
USPC ..... 361/213
See application file for complete search history.

(56) References Cited

U.S. PATENT DOCUMENTS

| | | | | |
|---|---|---|---|---|
| 9,380,689 | B2 | 6/2016 | Gefter et al. | |
| 2009/0219663 | A1* | 9/2009 | Sato | H01T 23/00 361/220 |
| 2017/0079125 | A1* | 3/2017 | Oldynski | H01T 19/00 |
| 2022/0158419 | A1* | 5/2022 | Willden | H01T 23/00 |

OTHER PUBLICATIONS

SimcoION™ Modulated Pulse AeroBar@ Model 5635.
Int'l Search Report and Written Opinion Appln No. PCT/US2022/032101 dated Sep. 22, 2022.
Simco-Ion, Technology Group, The Latest Ionization Tool with Offset Voltage and Feedback Control, Industry Exclusive Model 5645, https://www.facebook.com/simco.ion.technology/videos/new-products-introduction/250565230089085, accessed Apr. 28, 2021.

* cited by examiner

METHODS AND APPARATUS FOR ADAPTIVE CHARGE NEUTRALIZATION

BACKGROUND

This disclosure relates generally to ionization, and more particularly, to methods and apparatus for adaptive charge neutralization.

Ion emitters of charge neutralizers generate and supply both positive ions and negative ions into the surrounding air or gas media. To generate gas ions, the amplitude of the applied voltage must be high enough to produce a corona discharge between at least two electrodes arranged as an ionization cell. In the ionization cell, at least one electrode is an ion emitter and another one may be a reference electrode.

SUMMARY

Methods and apparatus for adaptive charge neutralization are disclosed, substantially as illustrated by and described in connection with at least one of the figures, as set forth more completely in the claims.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein:

FIG. 5 illustrates an example output signal from the power supply to the emitter of FIG. 2 to output positive and negative ions and to control a balance voltage, in which a pulse output is turned on.

The figures are not necessarily to scale. Wherever appropriate, similar or identical reference numerals are used to refer to similar or identical components.

DETAILED DESCRIPTION

Figure 1:
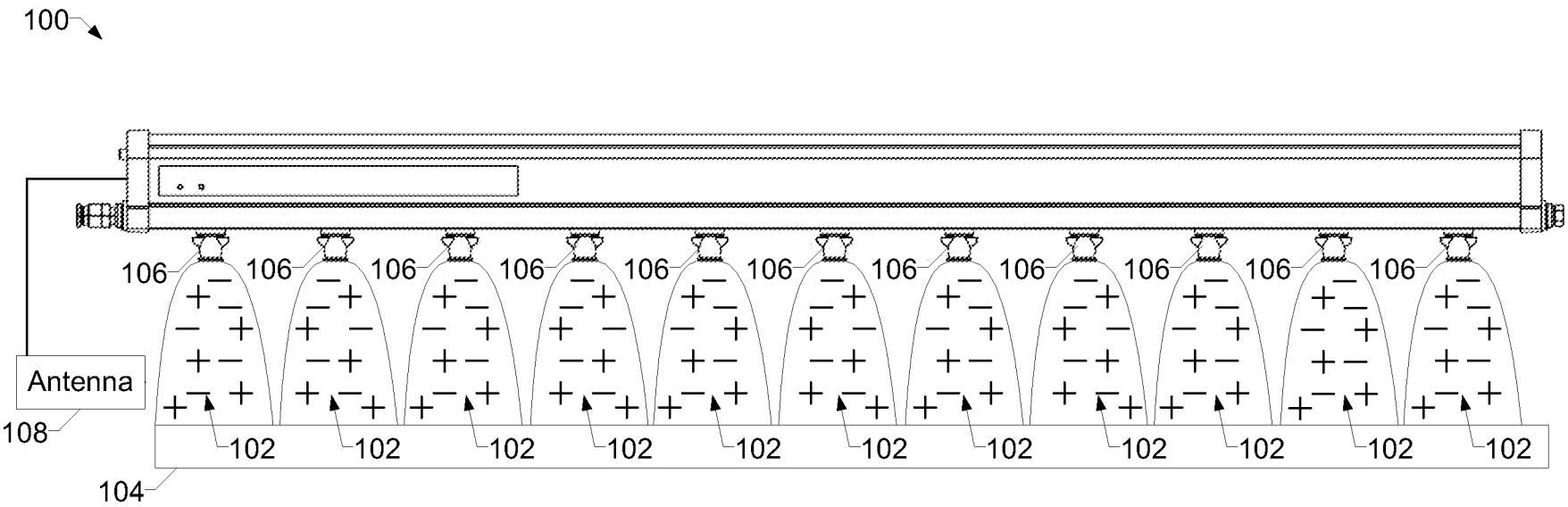
FIG. 1 illustrates an example AC charge neutralization system configured to control an ionization output based on balance voltage feedback, in accordance with aspects of this disclosure.

Ionizers, or charge neutralizers, emit positive and/or negative ions to discharge static electricity that may be present on a surface or substrate, such as in a manufacturing facility. Disclosed example methods and apparatus for charge neutralization can be used in class 1 cleanroom production environments, and are particularly useful for semiconductor chip manufacturing.

Conventional charge neutralizers emit a predetermined balance of positive ions to negative ions, which can be adjusted by the operator via software and/or an input device. However, conventional charge neutralizers lack feedback mechanisms to accurately determine whether the predetermined balance is appropriate to the charge present at the target during operation.

Disclosed example methods and apparatus for charge neutralization adapt an output ion balance based on balance voltage feedback. Example methods and apparatus for charge neutralization disclosed herein modulate a high voltage, high frequency AC signal using a DC offset signal to control generation of positive and negative ions. To adapt the output ion balance and thereby increase accuracy of the resulting balance voltage at the target, disclosed example methods and apparatus for charge neutralization increase or decrease the duty cycles of the DC offset signal to adapt the modulation of the high voltage, high frequency AC signal. Disclosed example methods and apparatus for charge neutralization are capable of more accurate balance voltages and substantially reduced swing voltages relative to conventional charge neutralizers. Some disclosed methods and apparatus for charge neutralization achieve a swing voltage of +/−5V, which has substantial benefits for voltage-sensitive and charge-sensitive applications, such as semiconductor manufacturing.

As used herein, "exceeding" a threshold voltage can occur in either the positive (e.g., more positive than the threshold) or negative (e.g., more negative than the threshold) directions.

As used herein, a "balance voltage" refers to a net voltage from ionization by the emitter.

The terms "ionization" and "charge neutralization" are used interchangeably in this document.

Disclosed example apparatus for charge neutralization include: a first emitter nozzle; a power supply configured to supply a high frequency alternating current (AC) signal to the first emitter nozzle; and control circuitry configured to: provide a polarity signal to the power supply to generate a DC offset signal, wherein a combination of the high frequency AC signal and the DC offset signal causes the power supply to output a positive ion generation pulse or a negative ion generation pulse; control the polarity signal to cause the power supply to provide a period of positive ion generation and a period of negative ion generation; determine a balance voltage at an output of the first emitter nozzle; and control the polarity signal to adjust a relative durations of the period of positive ion generation and the period of negative ion generation based on the balance voltage.

In some example apparatus, the combination of the high frequency AC signal and the DC offset signal has a peak voltage higher than a corona generating threshold voltage for the first emitter nozzle. In some example apparatus, the combination of the high frequency AC signal and the DC offset signal causes a voltage at the first emitter nozzle to exceed only one of a positive corona generating threshold voltage or a negative corona generating threshold voltage per high frequency AC cycle.

In some example apparatus, the control circuitry is configured to determine the balance voltage based on a feedback signal from an antenna. In some example apparatus, the antenna is positioned adjacent an ionization target. In some example apparatus, the control circuitry is configured to determine the balance voltage based on a feedback signal from a closed loop controller.

In some example apparatus, the power supply applies a resultant signal to the first emitter nozzle based on the combination of the high frequency AC signal and the DC offset signal, wherein the resultant signal causes a voltage at the first emitter nozzle to exceed a positive corona generating threshold voltage or a negative corona generating threshold voltage. In some example apparatus, the high frequency AC signal does not exceed either of the positive corona generating threshold voltage or a negative corona generating threshold voltage when the control circuitry controls the polarity signals to not generate the DC offset at the power supply.

In some example apparatus, the emitter point is silicon-based or titanium-based. Some example apparatus include a plurality of emitter nozzles including the first emitter nozzle. In some example apparatus, the control circuitry is configured to modulate the polarity signal based on the balance voltage to control a duty cycle of the positive ion generation pulses or the negative ion generation pulses. In some example apparatus, the control circuitry is configured to determine the balance voltage based on a feedback signal from an antenna. In some example apparatus, the first emitter nozzle includes an emitter point held within a stainless steel sleeve, wherein the power supply is configured to apply the combination of the high frequency AC signal and the DC offset signal to the emitter point with respect to the sleeve.

FIG. 1 illustrates an example AC charge neutralization system 100 configured to control an ionization output based on balance voltage feedback. The example AC charge neutralization system 100 outputs positive and negative ions 102 to neutralize electric charges on a target device or substrate 104.

To generate the ions 102, the example system 100 includes one or more ion emitter nozzles 106, which are coupled to one or more power supplies that provide a high voltage, high frequency AC signal for generation of the ions 102. The system 100 may include any number of emitter nozzles 106 to disperse ions 102 to a desired area or size of the target device or substrate 104. By alternating positive and negative ions, the example system 100 effectively neutralizes static charge present on the target device or substrate 104, while reducing or avoiding charging the target device or substrate 104 with the ions 102.

The system 100 of FIG. 1 alternates positive and negative ions by controlling the output voltage at the nozzles 106 to output periods of positive ions and periods of negative ions. The relative durations of the positive period to the negative period may be controlled based on a desired balance. In contrast with conventional charge neutralization systems, the example system 100 achieves a balance voltage within +/−5V by measuring the balance voltage via an antenna 108 and adjusting the ion balance based on the measurements. For example, the system 100 may adjust the relative durations of positive ion periods and negative ion periods to adjust the output balance. The antenna 108 may be positioned near the target 104 such that the antenna 108 measures a balance voltage representative of the output of system 100. Using the feedback from the antenna 108, the system 100 repeatedly (e.g., constantly) adjusts the relative balance of positive and negative ion generation periods.

Figure 2:
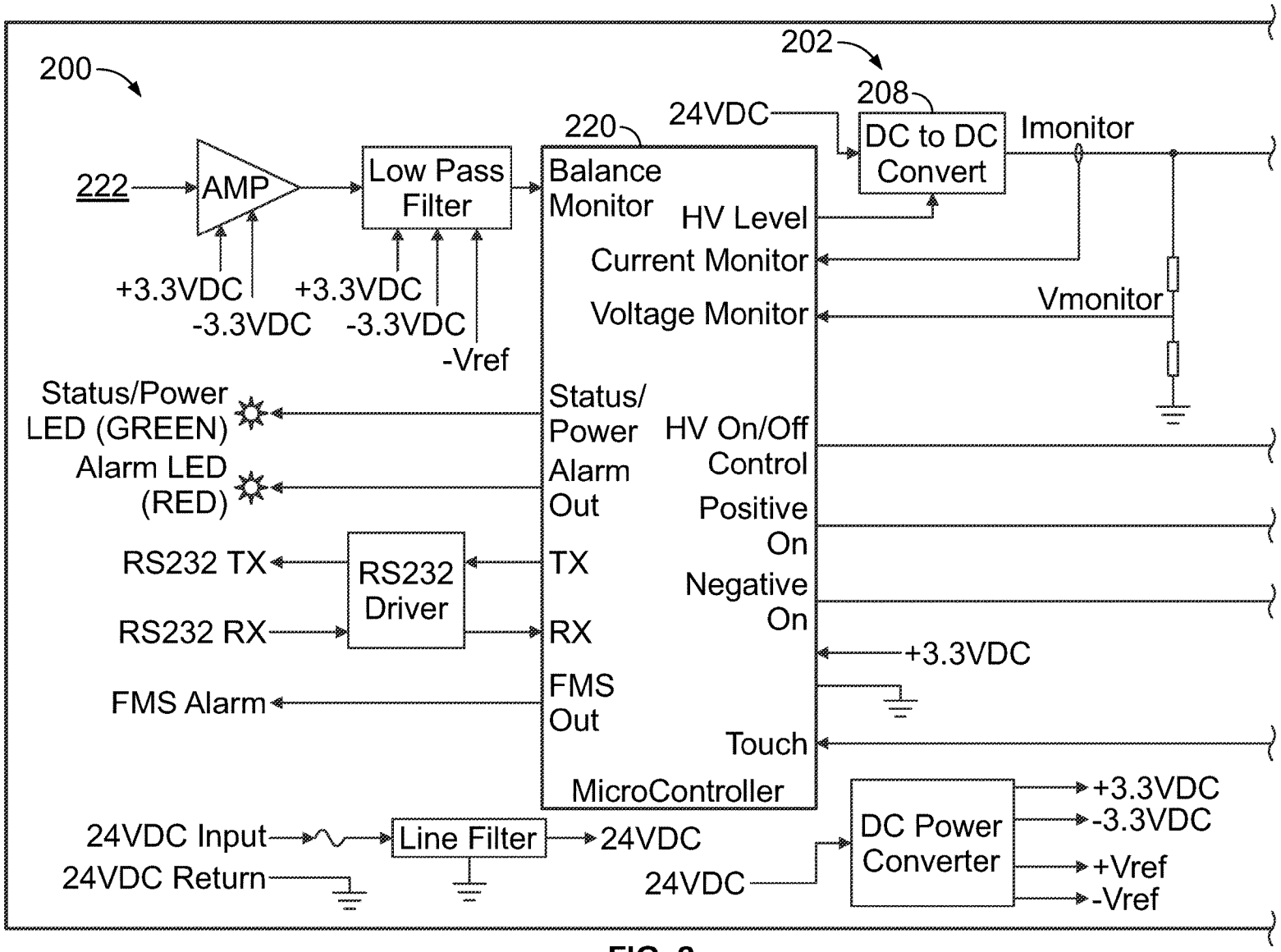
FIG. 2 is a block diagram of an example implementation of the AC charge neutralization system of FIG. 1.
Figure 2:
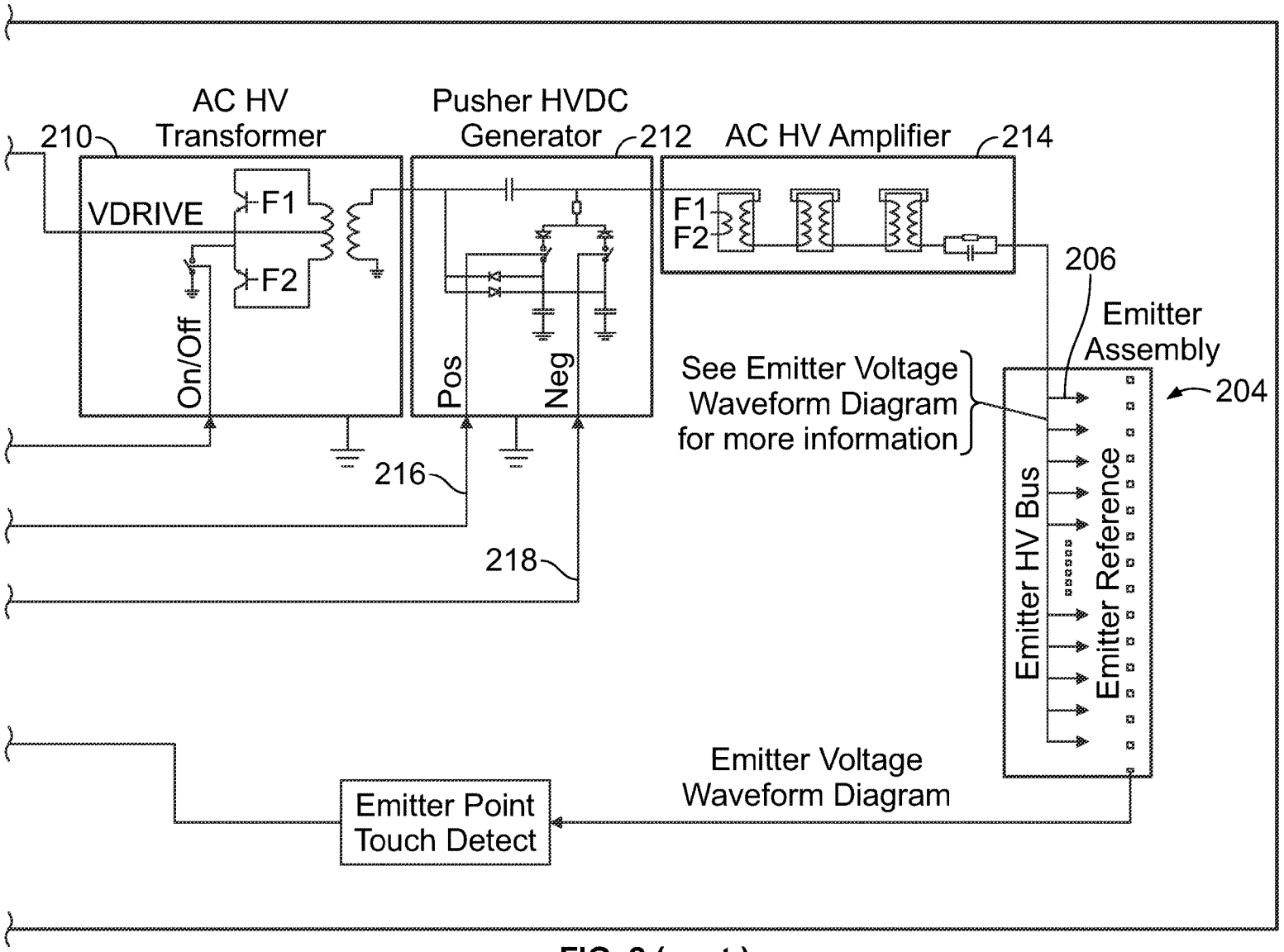

FIG. 2 is a block diagram of an example implementation of the AC charge neutralization system 100 of FIG. 1. The example of FIG. 2 includes an in-line ionizer 200 having a high voltage, high frequency (HVHF) power supply 202 which outputs an HVHF signal to an emitter assembly 204 having a number of emitters 206. In some examples, the emitters 206 are silicon-based or titanium-based. Based on the HVHF signal from the power supply 202, the emitters 206 create and output positive and negative ions.

The HVHF power supply 202 includes a DC-DC converter 208, an AC HV inverter 210, a DC offset generator 212, and an AC HV amplifier 214. The DC-DC converter 208 outputs a DC signal to the inverter 210, which generates an AC signal. The DC offset generator 212 selectively generates a DC offset signal based on polarity control signals 216, 218. If a positive polarity control signal 216 is active, the DC offset generator 212 generates a positive DC offset. Conversely, if a positive negative control signal 218 is active, the DC offset generator 212 generates a negative DC offset. If neither of the polarity control signals 216, 218 are active, the DC offset generator 212 does not generate a DC offset. The DC offset voltage, whether positive or negative, is combined with the AC signal output by the AC HV inverter 210 to generate a combined signal.

The AC HV amplifier 214 amplifies the voltage of the combined signal output by the DC offset generator 212.

The example ionizer 200 includes control circuitry 220 to control the HVHF power supply 202. The example control circuitry 220 may include a general purpose microprocessor, a microcontroller, a system-on-a-chip (SoC), an application specific integrated circuit (ASIC), and/or any other type of digital and/or analog circuitry.

The control circuitry 220 includes at least one controller or processor that controls the operations of the ionizer 200. The control circuitry 220 receives and processes multiple inputs associated with the performance and demands of the system. The control circuitry 220 may include one or more microprocessors, such as one or more "general-purpose" microprocessors, one or more special-purpose microprocessors and/or ASICS, and/or any other type of processing device. For example, the control circuitry 220 may include one or more digital signal processors (DSPs).

The example control circuitry 220 may include one or more storage device(s) and one or more memory device(s). Storage device(s) (e.g., nonvolatile storage) may include ROM, flash memory, a hard drive, and/or any other suitable optical, magnetic, and/or solid-state storage medium, and/or a combination thereof. The storage device stores data (e.g., ionization configuration data), instructions, and/or any other appropriate data. Memory device(s) may include a volatile memory, such as random access memory (RAM), and/or a nonvolatile memory, such as read-only memory (ROM). The memory device(s) and/or the storage device(s) may store a variety of information and may be used for various purposes. For example, the memory device(s) and/or the storage device(s) may store processor executable instructions (e.g., firmware or software) for the control circuitry 220 to execute.

The example control circuitry 220 outputs a target voltage level signal to the DC-DC converter 208 to control a DC output voltage to the AC HV inverter 210, and controls the polarity signals 216, 218 to the DC offset generator 212 to control the output. By controlling the polarity signals 216, 218, the example control circuitry 220 may control a balance of positive and negative ion output by the emitters 204.

The example control circuitry 220 further receives an balance voltage input 222 from a remote ion balance sensor, such as the antenna 108 of FIG. 1. The example control circuitry 220 may further include, or receive an input from, a balance detector which is connected to an antenna located near the ionization target. The balance detector may be implemented using a Simco-Ion™ Novx-based control system, such as the Novx 3352 Closed-loop Ionizer Controller or the Novx 3362 Closed-loop Ionizer Controller. In other examples, the control circuitry 220 or the ionizer 200 may include the balance detector, which receives the feedback signal directly from the antenna 108.

The example control circuitry 220 may execute a PID controller, and/or other type of filter, to filter the balance voltage measurement received via the antenna 108. In some examples, the balance voltage input 222 is determined using an analog-to-digital converter (ADC) circuit configured to receive the input signal from the antenna 108, and the control circuitry 220 applies one or more filters and/or control loops to the balance voltage input 222 to adjust a balance value for controlling the polarity signals 216, 218. The control circuitry 220 receives the balance voltage input 222 at a regular interval, as often as the ADC or other circuit can sample and deliver the balance voltage input 222, in response to one or more event types, and/or at any other times.

A pressurized source of air, nitrogen, or argon may be connected to the in-line ionizer 200 via an inlet to create an air flow or gas flow. In other examples, the emitter assembly 204 may permit flow of ambient air to carry the ions toward the output of the emitter assembly 204. When present, the air flow or gas flow entrains positive and negative ions and carries the ions through an ionizer outlet toward a target (e.g., target 104 of FIG. 1).

Figure 3:
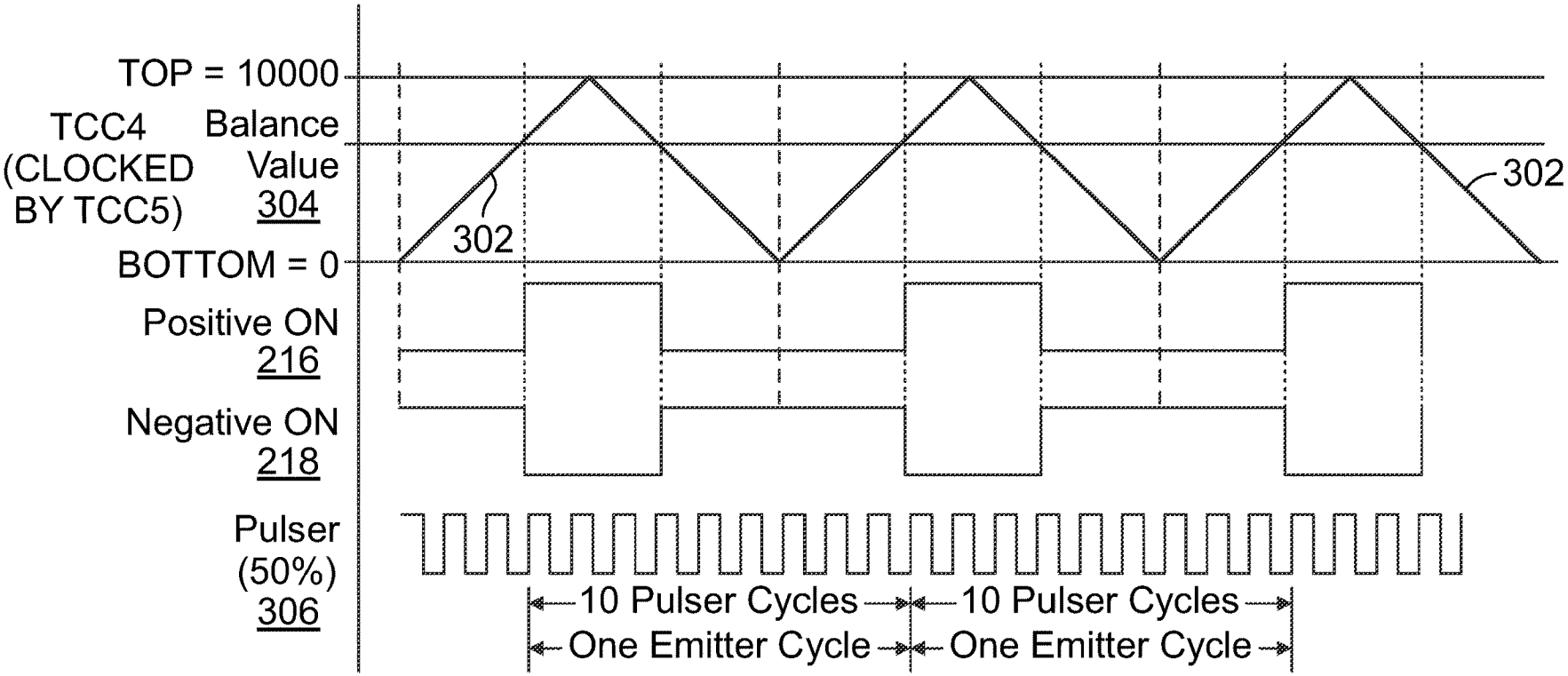
FIG. 3 illustrates example input signals to the power supply to the emitter of FIG. 2 to control output of positive and negative ions via a DC offset signal.

FIG. 3 illustrates example input signals to the power supply 202 of FIG. 2 to control output of positive and negative ions via a DC offset signal. The example control circuitry 220 compares a count signal 302 to a balance value 304, which is set by the control circuitry 220 based on a balance setpoint and based on the balance voltage input 222. The example control circuitry 220 may control the count signal to increment and decrement based on a clock signal of the control circuitry 220 to maintain a consistent timing. While the count signal 302 is less than the balance value 304, the control circuitry 220 controls the negative polarity signal 218 to be active and the positive polarity signal 216 to be inactive. Conversely, while the count signal is greater than the balance value 304, the control circuitry 220 controls the negative polarity signal 218 to be inactive and the positive polarity signal 216 to be active. Accordingly, the positive polarity signal 216 will be active longer as the balance value decreases (e.g., a less positive or more negative balance voltage is measured), and the negative polarity signal 218 will be longer as the balance value increases (e.g., a more positive or less negative balance voltage is measured). In some examples, the control circuitry 220 may further implement a pulse signal 306 to control the power supply 202. For example, the pulse signal 306 may be used to control an output of the AC HV inverter 210 to turn on and turn off the AC high frequency signal. While the polarity signals 216, 218 may be active at a given time, a low value (e.g., off) of the pulse signal 306 turns off the output of the power supply 202 until the pulse signal 306 is changed to a high value (e.g., on). The pulse signal 306 may be used to reduce the ionization swing voltage without significantly affecting the decay time, in some types of applications in which achieving both decay time and swing voltage requirements is difficult to achieve. Additionally or alternatively, the pulse signal 306 may be used to discourage ion recombination.

In the example of FIG. 3, the pulse signal 306 has a specific period and duty cycle, which may be controlled based on a clock signal of the control circuitry 220. However, in other examples, the period and/or duty cycle of the pulse signal 306 may be adjusted as desired, such as to achieve specific ionization rates.

In some examples, the control circuitry 220 may output a warning or alert if the balance value 304 reaches and/or remains at an upper or lower limit value. In such a case, there may be an error in the balance voltage measurements and/or the ionizer 200 is unable to provide sufficient ionization for the application.

Figures 4A, 4B:
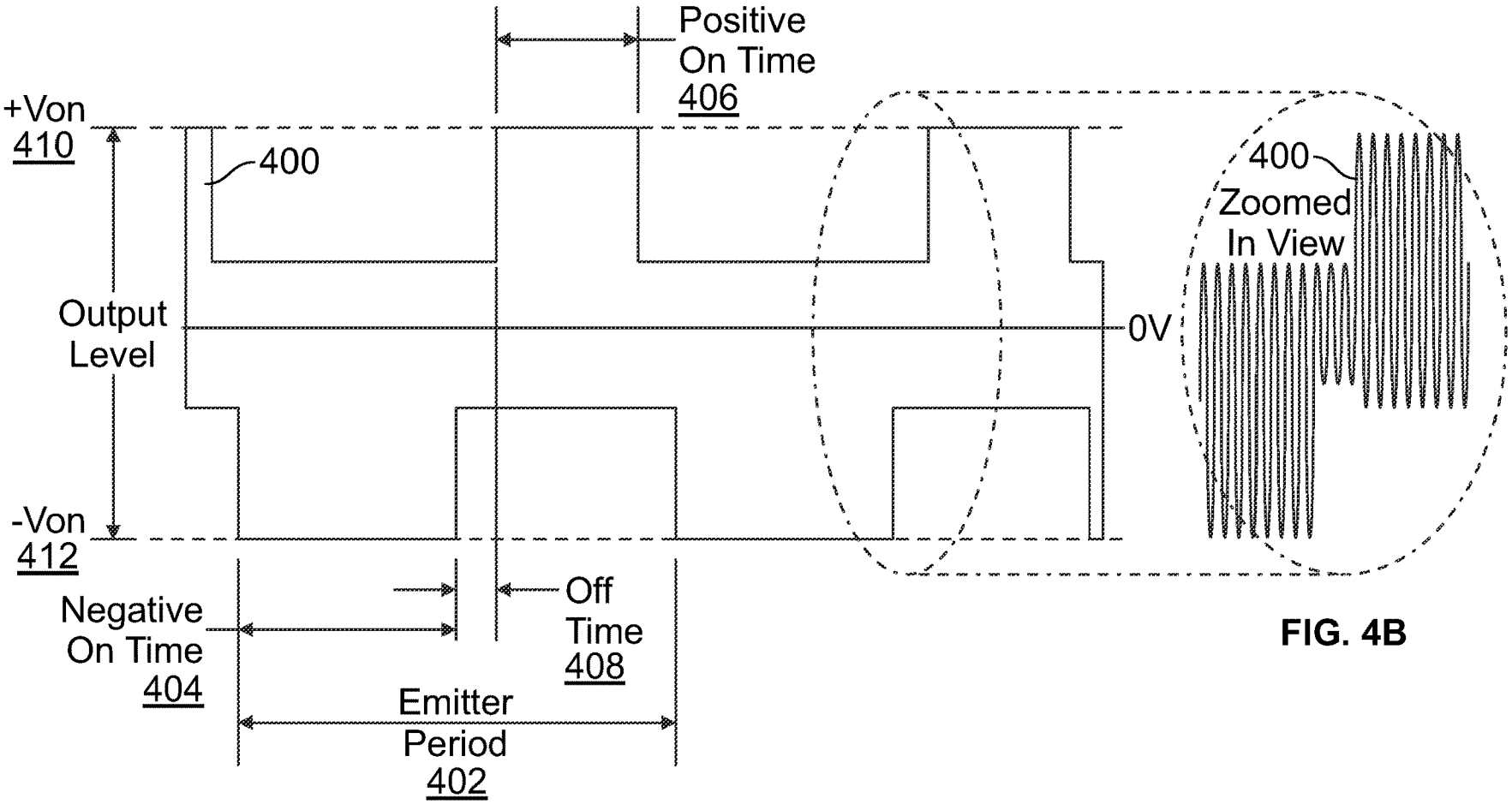
FIG. 4 illustrates an example output signal from the power supply to the emitter of FIG. 2 to output positive and negative ions and to control a balance voltage, in which a pulse output is turned off.

FIG. 4A illustrates an example output signal 400 from the power supply 202 to the emitters 206 of FIG. 2 to output positive and negative ions and to control a balance voltage, in which a pulse output (e.g., the pulse signal 306 of FIG. 3) is turned off. FIG. 4B illustrates a more detailed view of a portion of the output signal 400, showing the high frequency waves. In the example of FIG. 4A, the output signal 400 has a defined emitter period 402, which includes a negative portion 404, a positive portion 406, and one or more off portions 408. The off portion 408 may include one or more predetermined time periods that occur between sequential negative and positive portions, at the beginning of an emitter period 402, and/or at the end of an emitter period 402, to provide sufficient time for the power supply 202 to perform switching.

During the negative portion 404, the negative polarity signal 218 is active, and the emitters 206 generate and eject negative ions toward the target 104. During the positive portion 406, the positive polarity signal 216 is active, and the emitters 206 generate and eject positive ions toward the target 104. During the off portion 408, neither of the polarity signals 216, 218 are active, and the emitters 206 do not generate ions because the generated output signal 400 from the power supply 202 is not sufficient to exceed either a positive threshold voltage 410 or negative threshold voltage 412. The positive portion 406 and/or the negative portion 404 may have respective duty cycles with respect to the emitter period 402.

In response to the balance voltage input 222, the example control circuitry 220 may adjust the duty cycles of the negative portion 404 and/or the positive portion 406 by adjusting the balance signal 304 of FIG. 3, which in turn adjusts the polarity signals 216, 218.

The control circuitry 220 may respond to changes in the balance value 304 by determining corresponding durations of the negative portion 404 and/or the positive portion 406.

Figures 5A, 5B:
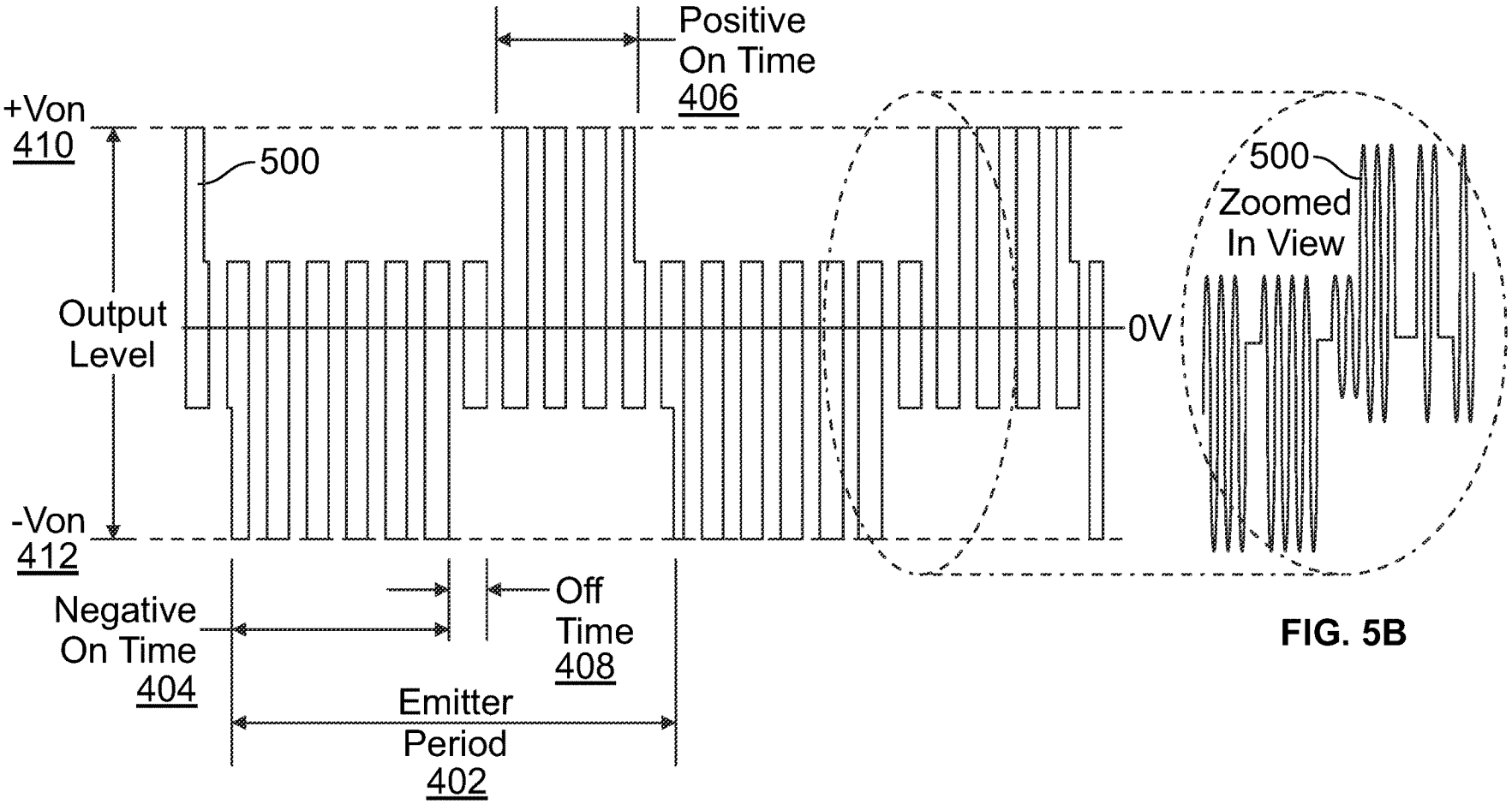

FIG. 5A illustrates an example output signal 500 from the power supply 202 to the emitters 206 of FIG. 2 to output positive and negative ions and to control a balance voltage, in which a pulse output (e.g., the pulse signal 306 of FIG. 3) is turned on. FIG. 5B illustrates a more detailed view of a portion of the output signal 500, showing the high frequency waves. The example output signal 500 is similar to the output signal 400 of FIG. 4A, with the exception that the HV output signal to the emitters 204 is turned off based on the pulse signal 306.

Figure 6:
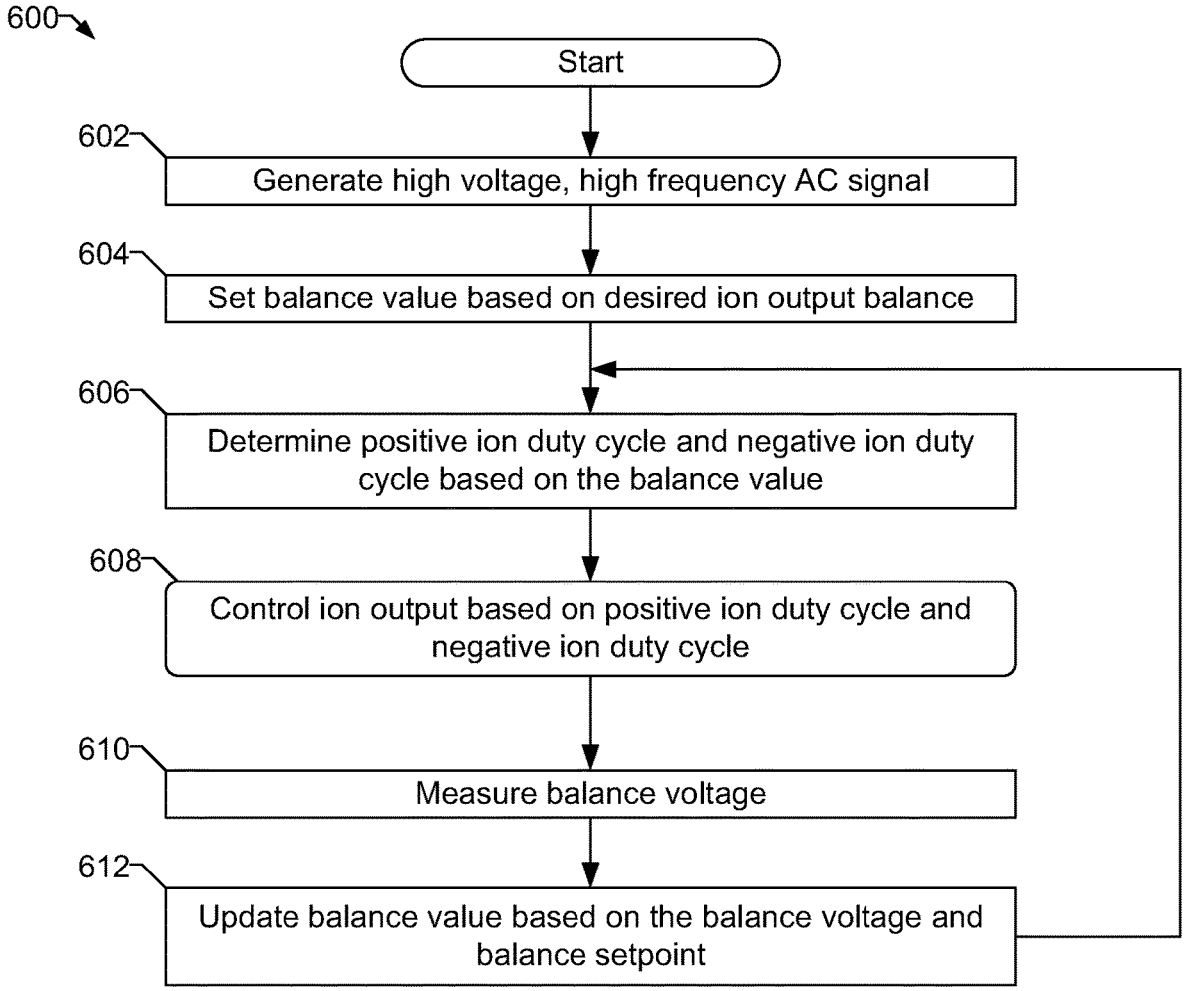
FIG. 6 is a flowchart representative of an example method to control an ionization output of the AC charge neutralization system of FIG. 1 based on balance voltage feedback.

FIG. 6 is a flowchart representative of an example method 600 to control an ionization output of the AC charge neutralization system of FIGS. 1 and 2 based on balance voltage feedback.

At block 602, the example HVHF power supply 202 generates a high voltage, high frequency AC signal. For example, the DC-DC converter 208 and the AC high voltage inverter 210 generate a high voltage, high frequency AC signal. At block 604, the control circuitry 220 sets a balance value based on a desired ion output balance. For example, the control circuitry 220 may set an initial balance value 304 based on a balance input, which controls the negative portion 404 and/or the positive portion 406.

At block 606, the control circuitry 220 determines a positive ion duty cycle (e.g., the positive portion 406 of the emitter period 402) and a negative ion duty cycle (e.g., the negative portion 404 of the emitter period 402) based on the balance value 304. For example, the control circuitry 220 may calculate the positive duty cycle and negative duty cycle based on the balance value 304 (e.g., within a predetermined range) and based on a predetermined off time 408. In some other examples, the control circuitry 220 does not calculate the positive ion duty cycle and negative ion duty cycle, and instead controls the polarity signals based on a comparison of the balance value 304 with a count signal 302 (e.g., in real-time).

At block 608, the control circuitry 220 controls ion output by the power supply 202 based on the positive ion duty cycle and the negative ion duty cycle. An example method to implement block 608 are disclosed below with reference to FIG. 7.

At block 610, the control circuitry 220 measures a balance voltage. For example, the control circuitry 220 may receive a balance voltage input 222 representative of the balance voltage. At block 612, the control circuitry 220 updates the balance value 304 based on the measured balance voltage and a balance setpoint. For example, the control circuitry 220 may apply the measured balance voltage and the balance setpoint to a PID controller to adjust the balance value 304. The PID controller, or other control loop, adjusts a commanded balance value 304 based on the difference between the measured balance voltage and the balance setpoint.

After updating the balance values (block 612), control returns to block 606 to continue updating the positive and negative duty cycles and continue outputting the HVHF signals to the emitters 206.

Figure 7:
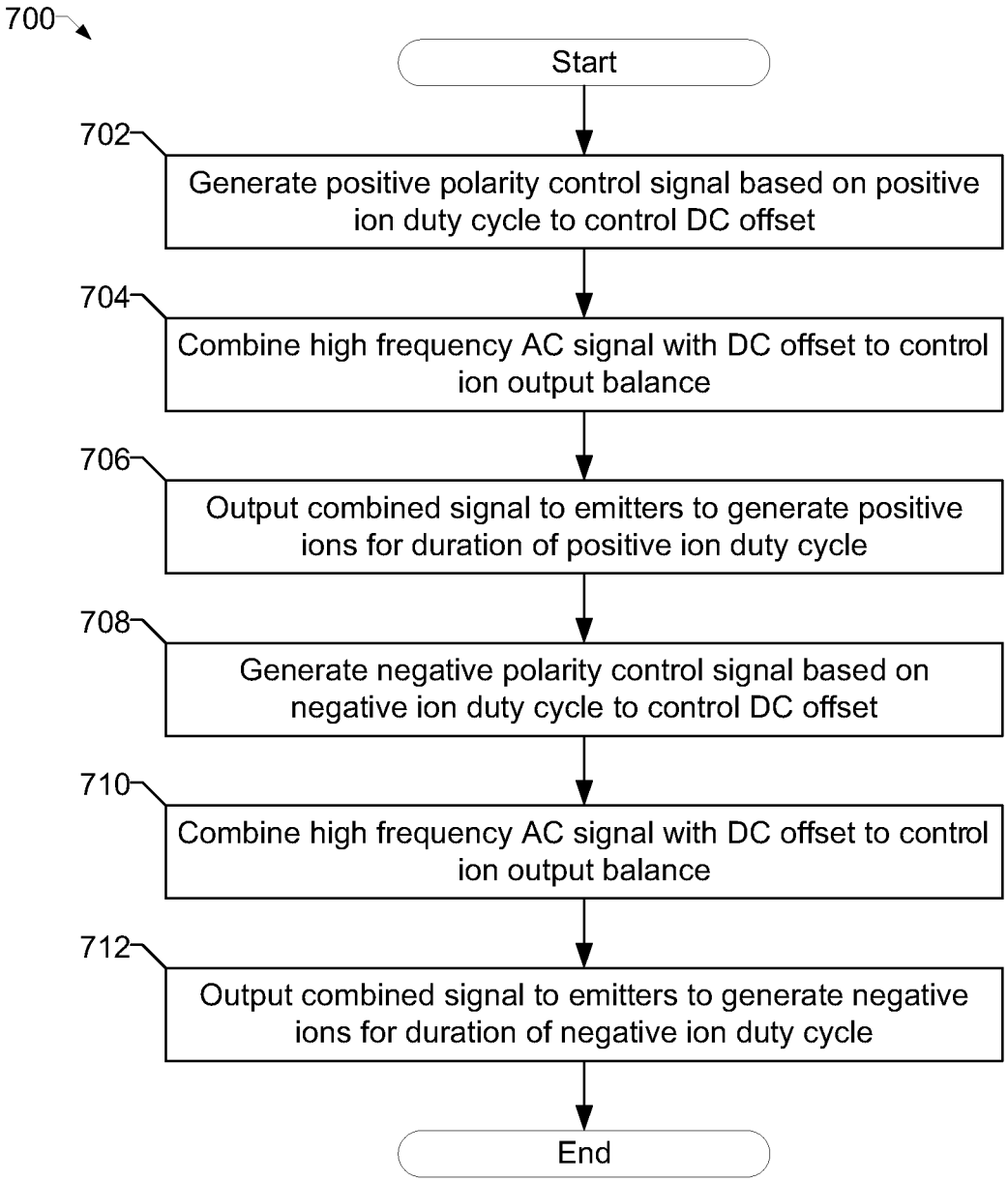
FIG. 7 is a flowchart representative of an example method to control ion output by a ionizer power supply, such as the power supply of FIG. 2.

FIG. 7 is a flowchart representative of an example method 700 to control ion output by a ionizer power supply, such as the power supply 202 of FIG. 2. The example method 700 may be performed by the control circuitry 220 of FIG. 2 to implement block 608 of FIG. 6. Prior to performance of the method 700, the example control circuitry 220 has determined a positive ion duty cycle and a negative ion duty cycle based on a balance signal 304.

At block 702, the control circuitry 220 generates a positive polarity control signal 216 based on a positive ion duty cycle to control a DC offset (e.g., at the DC offset generator 212). For example, the control circuitry 220 may hold the positive polarity control signal 216 active (e.g., on) and the negative polarity control signal 218 inactive (e.g., off) for the duration of the positive ion duty cycle.

At block 704, the DC offset generator 212 combines the high voltage, high frequency AC signal (e.g., from the AC HV inverter 210) with the DC offset to control the ion output balance. For example, the DC offset generator 212 combines the high voltage, high frequency AC signal with the DC offset generated based on the positive polarity control signal 216. For example, the AC HV amplifier 214 amplifies the combined DC offset and AC HVHF signal for output to the emitters 206.

At block 706, the power supply 202 outputs the combined signal to generate positive ions for the duration of the positive ion duty cycle. For example, the emitters 206 generate positive ions while the DC offset generator 212 generates a positive DC offset based on the positive polarity signal 216.

Following the positive ion duty cycle (e.g., block 702-706), at block 708 the control circuitry 220 generates a negative polarity control signal 216 based on a negative ion duty cycle to control a DC offset (e.g., at the DC offset generator 212). For example, the control circuitry 220 may hold the negative polarity control signal 218 active (e.g., on) and the positive polarity control signal 216 inactive (e.g., off) for the duration of the negative ion duty cycle.

At block 710, the DC offset generator 212 combines the high voltage, high frequency AC signal (e.g., from the AC HV inverter 210) with the DC offset to control the ion output balance. For example, the DC offset generator 212 combines the high voltage, high frequency AC signal with the DC offset generated based on the negative polarity control signal 218. For example, the AC HV amplifier 214 amplifies the combined DC offset and AC HVHF signal for output to the emitters 206.

At block 712, the power supply 202 outputs the combined signal to generate negative ions for the duration of the negative ion duty cycle. For example, the emitters 206 generate negative ions while the DC offset generator 212 generates a negative DC offset based on the negative polarity signal 218.

The positive and negative duty cycles may be separated by an off period (e.g., the off period 408) and/or may be interrupted by periodic pulses based on the pulse signal 306 of FIG. 3.

The present methods and systems may be realized in hardware, software, and/or a combination of hardware and software. The present methods and/or systems may be realized in a centralized fashion in at least one computing system, or in a distributed fashion where different elements are spread across several interconnected computing systems. Any kind of computing system or other apparatus adapted for carrying out the methods described herein is suited. A typical combination of hardware and software may include a general-purpose computing system with a program or other code that, when being loaded and executed, controls the computing system such that it carries out the methods described herein. Another typical implementation may comprise an application specific integrated circuit or chip. Some implementations may comprise a non-transitory machine-readable (e.g., computer readable) medium (e.g., FLASH drive, optical disk, magnetic storage disk, or the like) having stored thereon one or more lines of code executable by a machine, thereby causing the machine to perform processes as described herein. As used herein, the term "non-transitory machine-readable medium" is defined to include all types of machine readable storage media and to exclude propagating signals.

As utilized herein the terms "circuits" and "circuitry" refer to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y and/or z" means "one or more of x, y and z". As utilized herein, the term "exemplary" means serving as a non-limiting example, instance, or illustration. As utilized herein, the terms "e.g.," and "for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled or not enabled (e.g., by a user-configurable setting, factory trim, etc.).

While the present method and/or system has been described with reference to certain implementations, it will be understood by those skilled in the art that various changes may be made and equivalents may be substituted without departing from the scope of the present method and/or system. For example, block and/or components of disclosed examples may be combined, divided, re-arranged, and/or otherwise modified. In addition, many modifications may be made to adapt a particular situation or material to the teachings of the present disclosure without departing from its scope. Therefore, the present method and/or system are not limited to the particular implementations disclosed. Instead, the present method and/or system will include all implementations falling within the scope of the appended claims, both literally and under the doctrine of equivalents.

What is claimed is:

1. An apparatus for charge neutralization, the apparatus comprising:

a first emitter nozzle;

a power supply configured to supply a high frequency alternating current (AC) signal to the first emitter nozzle; and control circuitry configured to:

provide a polarity signal to the power supply to generate a DC offset signal, wherein a combination of the high frequency AC signal and the DC offset signal causes the power supply to output a positive ion generation pulse or a negative ion generation pulse;

control the polarity signal to cause the power supply to provide a period of positive ion generation and a period of negative ion generation;

determine a balance voltage at an output of the first emitter nozzle; and control the polarity signal to adjust a relative durations of the period of positive ion generation and the period of negative ion generation based on the balance voltage.

2. The apparatus as defined in claim 1, wherein the combination of the high frequency AC signal and the DC offset signal has a peak voltage higher than a corona generating threshold voltage for the first emitter nozzle.

3. The apparatus as defined in claim 1, wherein the combination of the high frequency AC signal and the DC offset signal causes a voltage at the first emitter nozzle to exceed only one of a positive corona generating threshold voltage or a negative corona generating threshold voltage per high frequency AC cycle.

4. The apparatus as defined in claim 1, wherein the control circuitry is configured to determine the balance voltage based on a feedback signal from an antenna.

5. The apparatus as defined in claim 4, wherein the antenna is positioned adjacent an ionization target.

6. The apparatus as defined in claim 1, wherein the control circuitry is configured to determine the balance voltage based on a feedback signal from a closed loop controller.

7. The apparatus as defined in claim 1, wherein the power supply applies a resultant signal to the first emitter nozzle based on the combination of the high frequency AC signal and the DC offset signal, wherein the resultant signal causes a voltage at the first emitter nozzle to exceed a positive corona generating threshold voltage or a negative corona generating threshold voltage.

8. The apparatus as defined in claim 7, wherein the high frequency AC signal does not exceed either of the positive corona generating threshold voltage or a negative corona generating threshold voltage when the control circuitry controls the polarity signals to not generate the DC offset at the power supply.

9. The apparatus as defined in claim 1, wherein the emitter point is silicon-based or titanium-based.

10. The apparatus as defined in claim 1, further comprising a plurality of emitter nozzles including the first emitter nozzle.

11. The apparatus as defined in claim 1, wherein the control circuitry is configured to modulate the polarity signal based on the balance voltage to control a duty cycle of the positive ion generation pulses or the negative ion generation pulses.

12. The apparatus as defined in claim 11, wherein the control circuitry is configured to determine the balance voltage based on a feedback signal from an antenna.

13. The apparatus as defined in claim 1, wherein the first emitter nozzle comprises an emitter point held within a stainless steel sleeve, wherein the power supply is configured to apply the combination of the high frequency AC signal and the DC offset signal to the emitter point with respect to the sleeve.

* * * * *